US007776227B2

(12) United States Patent
Roy

(10) Patent No.: US 7,776,227 B2
(45) Date of Patent: Aug. 17, 2010

(54) PROCESS FOR MANUFACTURING MICRO- AND NANO- DEVICES

(75) Inventor: Sudipta Roy, Tyne and Wear (GB)

(73) Assignee: University of Newcastle Upon Tyne, Newcastle Upon Tyne (GB)

( * ) Notice: Subject to any disclaimer, the term of this patent is extended or adjusted under 35 U.S.C. 154(b) by 317 days.

(21) Appl. No.: 11/658,272

(22) PCT Filed: Jul. 19, 2005

(86) PCT No.: PCT/GB2005/002795

§ 371 (c)(1),
(2), (4) Date: Apr. 18, 2008

(87) PCT Pub. No.: WO2006/010888

PCT Pub. Date: Feb. 2, 2006

(65) Prior Publication Data

US 2008/0283501 A1 Nov. 20, 2008

(30) Foreign Application Priority Data

Jul. 24, 2004 (GB) ..... 0416600.5

(51) Int. Cl.
*C23F 1/00* (2006.01)

(52) U.S. Cl. ..... 216/71; 216/67

(58) Field of Classification Search ..... None
See application file for complete search history.

(56) References Cited

U.S. PATENT DOCUMENTS

| | | | | |
|---|---|---|---|---|
| 2001/0007306 | A1* | 7/2001 | Ichinose et al. | 205/666 |
| 2003/0040173 | A1* | 2/2003 | Fonash et al. | 438/622 |
| 2005/0285275 | A1* | 12/2005 | Son et al. | 257/773 |
| 2006/0292848 | A1* | 12/2006 | Park et al. | 438/597 |
| 2008/0110857 | A1* | 5/2008 | Cohen | 216/41 |
| 2008/0121618 | A1* | 5/2008 | Cohen | 216/41 |
| 2008/0142936 | A1* | 6/2008 | Yilmaz et al. | 257/673 |

(Continued)

FOREIGN PATENT DOCUMENTS

EP 0 563 744 A2 * 6/1993

(Continued)

OTHER PUBLICATIONS

Dulal et al., "Characterisation of Co—Ni(Cu)/Cu Multilayers Deposited from a Citrate Electrolyte in a Flow Channel Cell" Electrochimica Acta, 2004, vol. 49, pp. 2041-2049.

(Continued)

*Primary Examiner*—Allan Olsen
(74) *Attorney, Agent, or Firm*—Buchanan Ingersoll & Rooney PC

(57) ABSTRACT

A method of depositing or etching a micro- or nano-scale pattern on a work piece is disclosed, including the steps of: (a) placing the work piece in an electrochemical reactor in close proximity to a patterned tool; (b) connecting the work piece such that it is the anode if is to be etched or the cathode if it is to be deposited, and the patterned tool such that it is the counter electrode; (c) pumping electrolytic fluid necessary for the electrolytic operation of the cell formed between the two electrodes; and (d) applying a current across the electrodes to etch or deposit the work piece.

9 Claims, 5 Drawing Sheets

U.S. PATENT DOCUMENTS

| | | | | |
|---|---|---|---|---|
| 2009/0050487 | A1 * | 2/2009 | Fang et al. | 205/135 |
| 2009/0195300 | A1 * | 8/2009 | Schimmel et al. | 327/537 |

FOREIGN PATENT DOCUMENTS

| | | |
|---|---|---|
| JP | 05-271998 | 10/1993 |
| WO | WO 02/103085 A1 | 12/2002 |
| WO | WO 03/095715 A1 | 11/2003 |

OTHER PUBLICATIONS

Green et al., "Electrodeposition of Gold from a Thiosulface-Sulfite Bath for Microelectronic Applications" Journal of The Electrochemical Society, 2003. vol. 150, No. 3, pp. C104-C110.

Perlstein et al., "Film Formation and Current Oscillations in the Electrodissolution of Copper in Acidic Chloride Media" J. Electrochem. Soc., 1985, vol. 132, No. 9, pp. 2159-2165.

Nouraei et al., "Analysis of Electrochemical Microfabrication Without Photolithography on Substrate" Proceedings of the 7th European Symposium on Electrochemical Engineering, Oct. 4-7, 2005, pp. 673-678, Toulouse, France.

Meuleman et al., "Effect of Current and Potential Waveforms on Sublayer Thickness of Electrodeposited Copper-Nickel Multilayers" Journal of The Electrochemical Society, 2002, vol. 149, No. 10, pp. C479-C486.

Roy et al., "Flow Cell Design for Metal Deposition at Recessed Circular Electrodes and Wafers" Chemical Engineering Science, 2001, vol. 56, pp. 5025-5035.

Roy et al., "Microscale Pattern Transfer Without Photolithogrphy of Substrates" International Symposium on Electrochemical Micro and Nano Technologies, Sep. 29 - Oct. 1, 2004, Tokyo, Japan.

Roy et al., "Influence of Titanium Surfaces on Osteoblast Behaviour" Poster, Cenamps Open Day, May 9, 2006, Durham Cricket Ground, UK.

Roy et al., "A Novel Method for Micro-pattern Transfer on Substrates Without Photolithography" NANOMED, Jun. 28-29, 2006.

Roy et al., "Electrochemical Structuring for Tissue Scaffolds: Novel Methodologies to Structure at the Micro and Nano Meter Scales" Nano Chemistry workshop of the COST Chemistry Action D19, Koc University, Sep. 1-3, 2005, Istanbul, Turkey.

Roy et al., "Modelling Challenges of Electrochemical Micro Pattern Transfer Without Photolithography" COST-D19 Metting, May 13-15, 2006, Sitges, Spain.

Roy et al., "Micron Scale Pattern Transfer Without Photolithography of Substrates" EDNANO-4, Mar. 16-18, 2006, Dresden, Germany.

Roy et al., "A Model for Pattern Transfer Process Without Photolithography of Substrates" EDNANO-5, Jun. 7-9, 2007, Lasi, Romania.

Schönenberger et al., "Microscale Pattern Transfer Without Photolithography of Substrates" Electrochimica Acta, 2005, vol. 51, pp. 809-819.

* cited by examiner

PROCESS FOR MANUFACTURING MICRO- AND NANO- DEVICES

This application is a National stage filing under 35 U.S.C. §371 of International Application No. PCT/GB2005/002795, filed on Jul. 19, 2005, which in turn claims priority to British Application No. 0416600.5, filed Jul. 24, 2004, the entire contents of which are incorporated herein by reference.

FIELD

This invention relates to a process, which can be used to selectively electrochemically deposit, or etch, micro patterns in various substrate materials, preferentially for the fabrication of micro-devices, nano-devices, and the like.

BACKGROUND

In the discussion that follows, reference is made to certain structures and/or methods. However, the following references should not be construed as an admission that these structures and/or methods constitute prior art. Applicants expressly reserve the right to demonstrate that such structures and/or methods do not qualify as prior art.

Micro- and nano-machined devices are used in a variety of industries including electronics, optical, telecommunications, data storage, medical, chemicals etc. Conventional micro scale electrochemical deposition or etching has led to advances in sensor technologies, optical display technology, and micro-actuators. A simple example is the micro-device used to inflate an automobile air bag, whereby the bag is filled with nitrogen released from a solid compound, wherein the solid compound is a micro resistor, which is heated by an electric current. In the medical field micron sized patterns, on certain substrates, have been shown to promote the growth of certain cells, a particular application being in tissue engineering.

The main physical attribute of a micro-device is that the scale of its features are measured in microns, that is in millionths of a metre, and that of a nano-device, wherein the scale of the device's features are measured in nano-metres, that is in thousand-millionths of a metre. Owing to their small size, and their often complex geometries, micro- and nano-devices cannot be manufactured by simple mechanical methods such as cutting, sawing, milling, drilling etc. Under the prior art, methods involve the use of photo-lithography to impose the desired pattern on the substrate of the work-piece followed by chemical etching. The work-piece is first coated with a photo resist. It is then exposed to the image of a photographic mask using visible or ultra-violet light. Unexposed photo-resist is then washed off, and the work-piece etched. The remaining photo resist protects the surface from the etchant. Thus the original photo-mask pattern may be reproduced as a machined surface on the work-piece. The technology of photo-lithography is now well refined, particularly because of its extensive application in the semiconductor industry, and it is for this reason that it has been extended to the fabrication of micro- and nano-devices and featured substrates.

These conventional photo-lithographic techniques for the fabrication of micro- and nano-devices have a significant drawback in the complexity of the process, use of materials, and their disposal to the environment. Every work-piece must be coated with photo-resist, exposed under the photo-mask, and washed before etching. Following the etch, the residual photo-resist must be removed.

SUMMARY OF THE INVENTION

The current inventive process overcomes this problem by eliminating the need for applying the photo-lithographic process to every work-piece. Instead, it is applied once only, to the tool, which then may be re-used many times to produce a large number of work-pieces by electro-chemical deposition or etching.

According to the current invention a tool is made such that it is selectively coated by a patterned, electrically insulating, chemically inert, coating, which may be applied by any appropriate method, the preferred method utilising a polymer photo-resist and conventional lithographic techniques known in the art. The tool thus formed is then placed in an electrochemical reactor in close proximity to the work-piece that is to be deposited or etched. The reactor is arranged such that the tool forms the counter electrode, and the work-piece to be deposited or etched, forms the cathode or anode, respectively. The close proximity spacing between the two electrodes is arranged to be dimensionally similar to, and preferably smaller than, the smallest feature that is to be etched in the work-piece. Electrolytic fluid necessary for the electrolytic operation of the cell is continuously pumped through the narrow spacing between the two electrodes to remove reaction products and heat whilst an appropriate electric current is passed through the system.

Thus the present invention provides a method of depositing or etching a micro- or nano-scale pattern on a work-piece, comprising the steps of:

a) placing the work piece in an electrochemical reactor in close proximity to a patterned tool;
b) connecting the work piece such that it is the anode if is to be etched or the cathode if it is to be deposited, and the patterned tool such that it is the counter electrode;
c) pumping electrolytic fluid necessary for the electrolytic operation of the cell formed between the two electrodes; and
d) applying a current across the electrodes to etch or deposit the work piece.

The tool may be patterned by conventional means to yield a tool which is selectively coated with a patterned, electrically insulating and chemically inert coating. The coating needs to be chemically inert to the conditions in the electrochemical reactor. Typically, the patterning may be carried out on a convention polymer photoresist using known lithographic methods.

The electrochemical reactor is designed to keep the two electrodes (which are the tool and the work piece) at a constant separation across their faces, within acceptable margins of error. It allows for the electrodes to be connected so as to pass a current between them and for the electrolytic fluid to be pumped between the electrodes.

The electrolytic fluid is to be selected according to the electrochemical reaction being carried out. For example, in the examples below a copper sulphate solution is used in etching a copper disc.

The material of the electrodes is selected according to the nature of the final product desired. In the examples below, copper discs are etched. Many micro- and nano-scale patterns are to be found on semiconductor substrates with metals such as gold, aluminium or copper forming the pattern.

Because of the close spacing between the two electrodes, it being of similar dimension to the required features in the work-piece, the anode is preferentially etched in the areas that face exposed parts of the counter electrode, relative to those areas of the cathode that are masked by the insulating coating.

The dimensional similarity between the distance between the electrodes and the features to be patterned means that these distances can be in a ratio of about 10:1 or 5:1 to 1:5 or 1:10, preferably about 10:1 to 1:2, and more preferably about 10:1 to 1:1. Thus although in some embodiments it may be preferred that the distance between the electrodes is smaller than the size of feature to be patterned, in other embodiments the converse is true, i.e. the distance between the electrodes is larger than the size of feature to be patterned, by up to 10 times.

The current applied may be constant or varied, as may the voltage which causes the current to flow.

After an appropriate period in the electrochemical reactor, the work-piece is etched with a micro- or nano-scale pattern on its surface replicating the pattern imposed on the tool, whereupon it may be removed from the electrochemical reactor. Many work-pieces may be sequentially processed in this way using the one tool. Each work-piece may be subsequently presented to other tools for further complex processing.

Under the prior art there is a multi-step process to each stage of the fabrication of each micro- or nano-device comprising of:

(i) coating the work-piece with a photo-resist;

(ii) exposing the work-piece to light through a photo-resist mask;

(iii) removing the photo-resist from the appropriate areas using a solvent;

(iv) exposing the work-piece to an etching (or deposition) solution;

(v) removing the remaining photo-resist using a solvent.

Under the process described herein, once a tool has been formed using the process under the prior art as described above, there is a single-step process to each stage of the fabrication of each micro- or nano-device comprising of:—offering the work-piece to the tool within the electrochemical reactor, and electrochemically depositing or etching micro- or nano-patterns on it.

The re-useable tool will eventually require replacement, however, a great advantage will be enjoyed in the reduced use of solvents, reduced processing time, and of product reproducibility.

BRIEF DESCRIPTION OF THE DRAWING FIGURES

The following description of preferred embodiments can be read in connection with the accompanying drawings in which like numerals designate like elements and in which.

DETAILED DESCRIPTION

Figure 1:
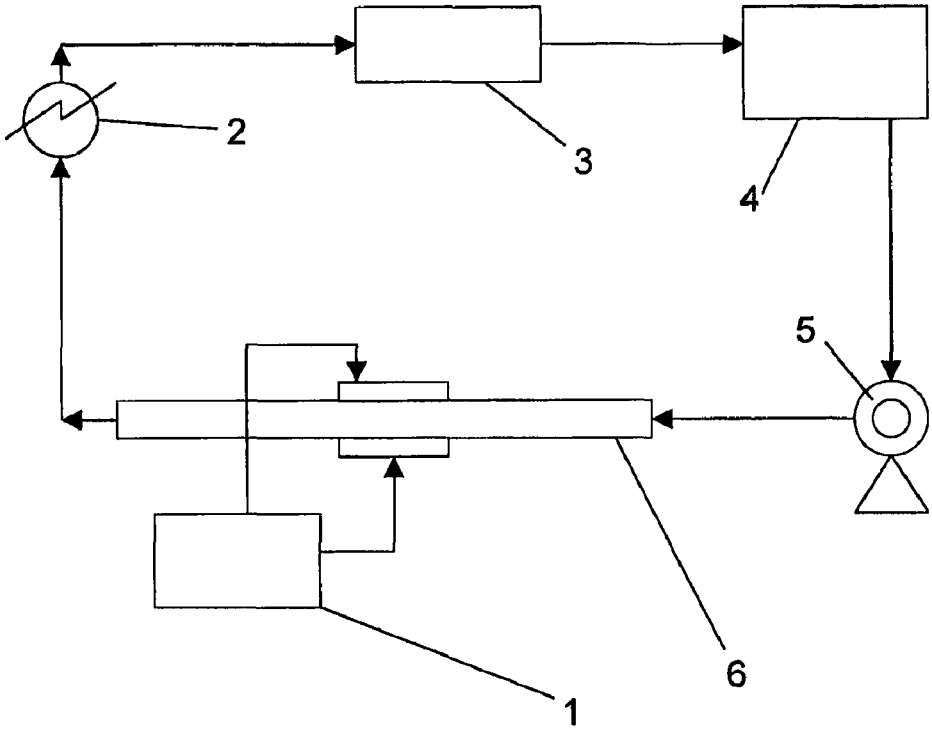
FIG. 1 shows the flow process of an embodiment of a system according to the invention.
Figure 2:
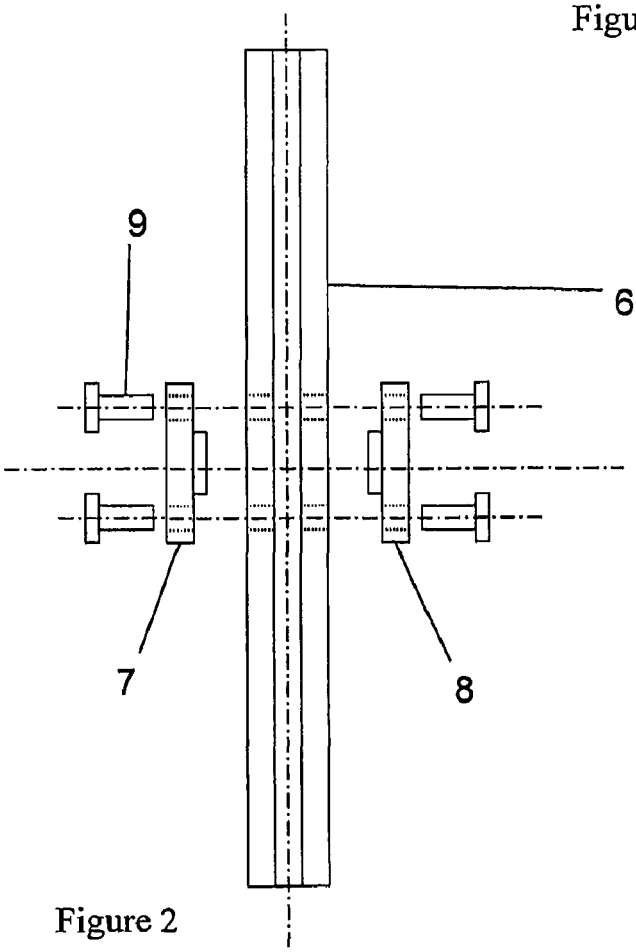
FIG. 2 shows a cross section in one plane of the electrochemical reactor according to the invention.
Figure 3:
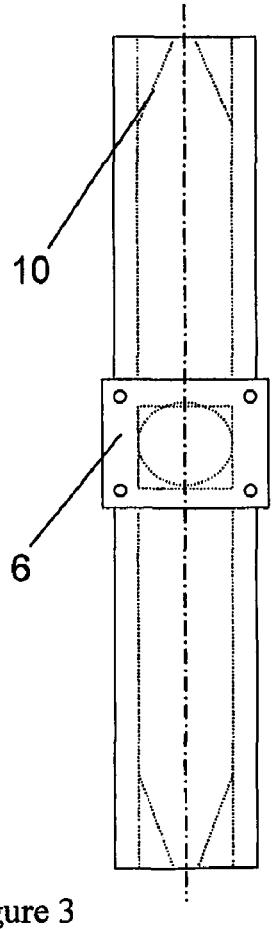
FIG. 3 shows a cross section of the electrochemical reactor according to the invention in a plane orthogonal to that of FIG. 2.

The vertical flow system for the main etching experiments has been described in literature for electrodeposition experiments (Meuleman, W. R. A., et al., *J. Electrochem. Soc.* 149, C479-C486 (2002); Dulal, S. M. S. I., et al., *Electrochim. Acta,* 49, 2041-2049 (2004)). The design of the flow cell, which is shown in FIGS. 2 and 3, was based on a model previously constructed by Roy et al. (Roy, S., et al., *Chem. Eng. Science,* 56, 5025 (2001)). The flow system, which is illustrated in FIG. 1, consisted of the flow cell 6 with two electrode holders, one for the cathode 7 and one for the anode 8, a heat exchanger 2, a filter unit/settling tank 3, an electrolyte reservoir 4, magnetically coupled pump 5, and a flow meter (not shown). The power supply 1 is coupled to the anode and cathode.

The cross-section of the flow cell as seen in FIG. 2 was rectangular and the electrolyte circulated upwards through the channel. The electrolyte was stored in a reservoir 4 and the velocity of the electrolyte was controlled by a manual valve and monitored by a digital flow meter. The distance between the channel walls, except at the electrodes, was 3.0 mm. To prevent the formation of any eddy at the inlet and outlet of the flow channel, the entry and exit sections 10 were conically shaped.

Figure 4:
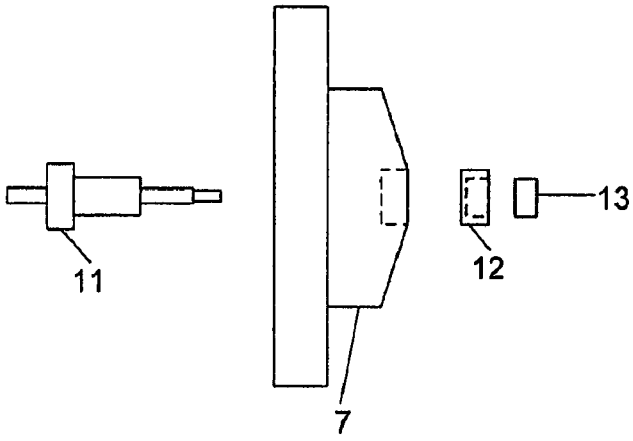
FIG. 4 shows an exploded view of an electrode holder for use in the electrochemical reactor of FIGS. 2 and 3.

The two electrodes holders 7, 8 were placed in the middle of the flow channel, whose positions are adjusted with micro-precision control screws or shims 9. An interelectrode gap of 0.5 mm between the two electrodes was achieved by using a specific chamfered shape of the electrode holders, which is shown in FIG. 4. Copper rods 13, of diameter of 1.0 cm and 99.99% purity, were segmented into 3 mm thick discs, and inserted into a Teflon cup 12 which fitted into the holder 7. The back of these electrodes was connected to another copper rod 11 via a spring, as illustrated in FIG. 4. In each experiment, the electrodes were loaded in their holders and inserted into the cell.

Electrolyte was then circulated through for approximately five minutes at a flow rate of 70-90 $cm^3s^{-1}$ (>3.5 $ms^{-1}$ flow velocity) to eliminate air bubbles from the electrode surface. Since there was no reference electrode in these experiments, only the cell potential was monitored or controlled. All experiments, therefore, were galvanostatic. During the course of a pattern transfer experiment, the cathode was plated with copper, which was removed using a 25% $HNO_3$ solution.

Electrode Preparation

Each copper disc, which served as an anode, was polished to a mirror finish using #1200, #2400, and #4000 grit emery paper. The measured surface roughness of the polished copper discs was about 20-40 nm, but larger machining damage remained—however, these did not influence the results. After polishing, the copper discs were slightly convex; the copper discs were found to be approximately 60 μm thicker in the middle than at the edges.

The cathodes were gold coated glass discs with a diameter of 1.0 cm. Electrical contact between the gold surface and the back of the glass disc was made by painting the back and side wall with conductive silver paint (RS Components). The cathode was patterned using photolithography by modifying a standard photolithographic process for 100 mm wafers.

In the photolithography experiments, each glass disc was cleaned with acetone and glued at the centre of a clean silicon wafer with double-sided adhesive tape. Then, the glass discs were individually coated with photoresist (Shipley, SPR 220-7.0) using a EV 101 Spin Coater. A few drops of resist were added manually to the middle of the glass disc at a spin rate of 500 rpm. After spin coating the samples were baked at 95° C. for one hour to remove any excess solvent. Four coated glass discs were then placed on a silicon wafer and the glass photomask with the micro-pattern was placed onto the four glass discs. The photoresist was then exposed to UV light through the photomask by using the EV 620 Contact Aligner. The exposure time was 35 seconds. The samples were then developed for two minutes using a developer (Shipley, MF-26A). After cleaning with deionised water, the cathodes finally were hard-baked for one hour at 105° C. These photolithography procedures produced a resist thickness of 7-8 μm.

Figure 5:
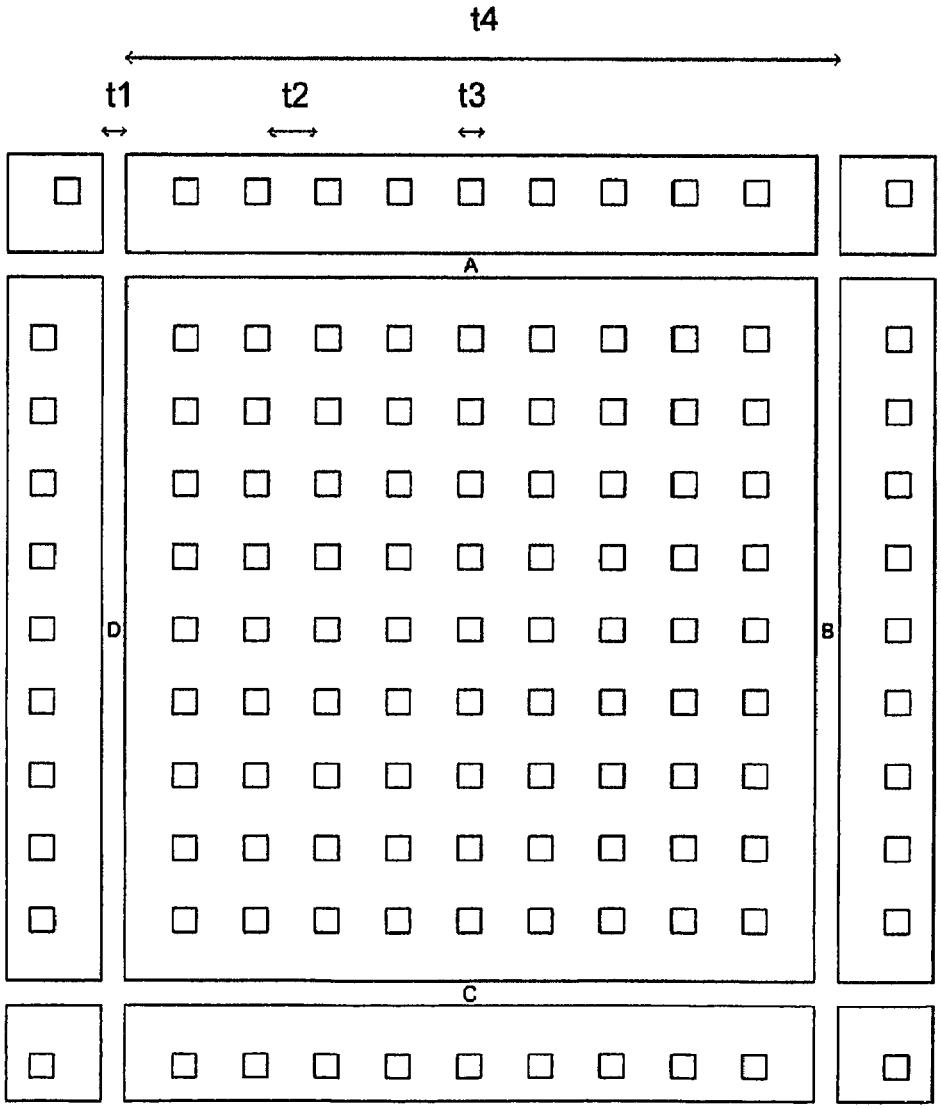
FIG. 5 shows a micro-pattern used in the pattern transfer experiments.

The micro-pattern used for the primary etching experiments was previously used in a work about a novel gold electrodeposition process for microelectronic applications (Theory and Practice of Pulse Plating, Ed. J-C. Puippe and F. Leaman, Published by American Electroplaters and Surface Finishers Society, Orlando, Fla., USA, ISBN 0-936569-02-6 (1986)). The mask pattern consisted of large squares, which were delineated by lines ABCD, as illustrated in FIG. 5. When this pattern is transferred to a glass disc, the grey regions represent the resist covered areas and the white regions denote exposed areas. As shown, the uncovered areas consist of lines with 100 μm thickness (t1) and 3.0 mm length (t4). Within each large square, 81 smaller squares of 100 μm (t3) sides are placed. These squares were separated from each other by a distance of 200 μm (t4). The advantage of using this pattern is that the replication of both 1 and 2 dimensional features can be investigated.

Other micro-patterns were designed to test the pattern transfer performance of the technique. One of these was a pattern consisting of straight lines with varying width and spacing. These pattern designs allowed examination of the reproduction of one-dimensional structures of small widths—as small as 10 μm. Since the width of the lines and line spacing were changed in these experiments, the current density and the feature width could be changed independently. This allowed observation if either of these two factors had any effect on the pattern transfer.

Current and Potential Control

A variety of current and potential controls were used in the pattern transfer experiments. Etching experiments at constant current between 0.3 $Acm^{-2}$ and 1.0 $Acm^{-2}$ were performed with a DC power supply (PL 310, Thurlby Thandar). Etching experiments at a constant cell voltage were carried out by using voltage control on the same instrument.

The applied current and cell voltage as well as the corresponding time to obtain the same total etch depth are listed in Table 1. The table also shows the different electrolytes and conductivities used in the etching experiments.

TABLE 1

| Electolyte Composition | Conductivity [$Sm^{-1}$] | Constant Current density [$Acm^{-2}$] | Constant Cell Potential [V] | Etching time to obtain same total depth [s] |
|---|---|---|---|---|
| 0.1 M $CuSO_4$ & 0.5 M $H_2SO_4$ | 46.0 | 0.3-1.0 | | 60-678 |
| 0.1 M $CuSO_4$ | 2.7 | 0.3-1.0 | 5.0 | 60-180 |

The electrolyte flow rate was varied between stagnant and 150 $cm^3s^{-1}$ (which corresponds to a fluid velocity of 7.5 $ms^{-1}$) to see if it had any effect on the etching performance. Pulsed etching experiments were performed by using a pulse current power supply (CAPP-25/20-K, Axel Akerman). Pulsing cell voltage was applied. For a square wave pulse with peak potential $V_p$, pulse-on time $t_p$, and pulse period $t_{pp}$, (so that $t_p/t_{pp}$ is the duty cycle), the "average" cell potential $V_a$ for the current waveform is given by:

$$V_a = V_p \times (t_p/t_{pp}) \quad (1)$$

The "average" cell potential includes ohmic drop within the electrolyte and potential changes due to non-Faradaic processes (Hoar, T. P., "The Anodic Behaviour of Metals", *Modern Aspects of Electrochemistry, Vol.* 2, The University Press, Glasgow (1959)). Table 2 shows the parameters used during pulsed voltage etching experiments.

TABLE 2

| $V_p$ [V] | $t_p$ [ms] | $t_p/t_{pp}$ | Cycles |
|---|---|---|---|
| 10 | 1.0 | 0.02 | 4000 |
| 10 | 1.0 | 0.01 | 4000 |
| 10 | 10.0 | 0.1 | 4000 |
| 20 | 1.0 | 0.02 | 4000 |
| 20 | 1.0 | 0.02 | 8000 |
| 20 | 1.0 | 0.02 | 12000 |
| 20 | 1.0 | 0.02 | 20000 |
| 20 | 1.0 | 0.01 | 4000 |
| 20 | 10.0 | 0.1 | 4000 |

Characterization

For the characterization of the patterned cathodes and the etched copper anodes different measurement systems were used. For feature lengths and widths measurements, an Olympus MX50 microscope, equipped with a BRSL 'DAVID' system was used. An Alpha-Step 200 stylus profilometer was used to determine the etch depth and surface roughness. Non-contact 3D measurements were carried out with a ZYGO NewView 5020 optical profiler to measure depth and length scales. Scanning electron microscopy was used to determine the surface morphology as well as defects before and after a pattern transfer experiment. The scales in FIGS. 6 to 8 is presented using the optical profiler, because it shows both the feature length, depth as well as roughness—other scaling has not been shown for brevity.

Experiments

The effect of fluid flow on pattern transfer was first determined. This experiment was carried out first because at the high electrode overpotentials attained during transpassive etching, oxygen evolution is expected. The evolving oxygen could block the electrode surface, thereby preventing further etching, caused by the high localized resistance offered by a gas bubble. Pattern transfer experiments at constant or pulsed current and voltage revealed that this could seriously impair the etching performance.

When a gas bubble was trapped within the resist, it resulted in local circular areas (the shape of a bubble) remaining un-etched. In addition, the photoresist on the cathode (counter electrode) was often detached due to the turbulence generated by gas evolution.

As the electrolyte flow rate was increased, the gas bubbles detached from the surface more easily and electrochemical dissolution could proceed. The etching performance for electrolyte flow rate of 70 $cm^3s^{-1}$ (3.5 $ms^{-1}$) were found to give satisfactory performance, and therefore, this flow rate was used for all further experiments described below.

The next parameter to be investigated was the electrolyte conductivity. The effect on pattern transfer was examined by direct current experiments using electrolytes of different conductivity. The applied current density was fixed at 1.0 $Acm^{-1}$ and the etching time was 180 seconds in these experiments.

The etched features for acidified electrolytes, such as 0.1 M $CuSO_4$ with 0.5 M $H_2SO_4$ electrolyte, were found to be a 'derivative' of the tool pattern; for example a square shape, such as the small squares of FIG. 5, produced sine-wave like features on the substrate.

Figure 6A:
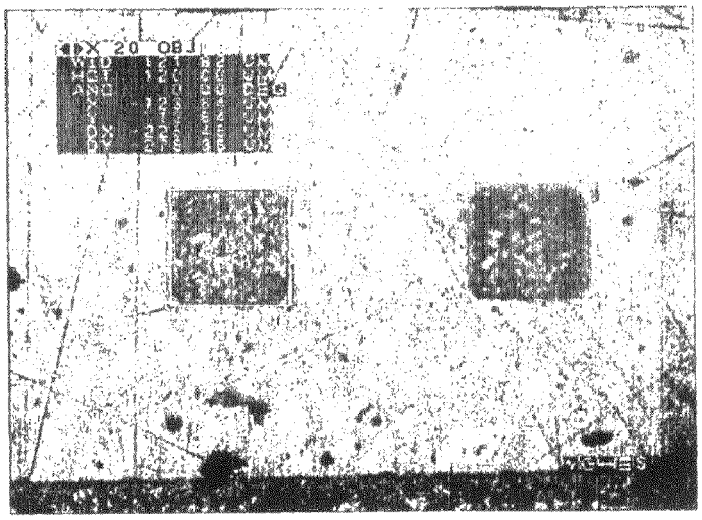
FIG. 6 shows (a) SEM, (b) 2D and (c) 3D profiles of a copper anode etched according to the present invention.
Figure 6B:
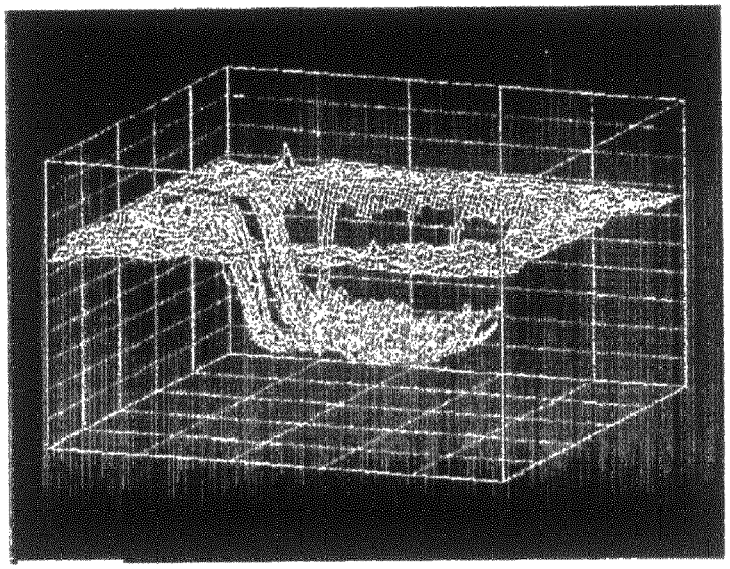
Figure 6C:
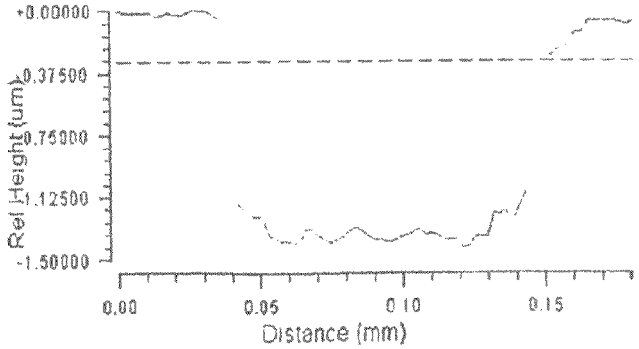

Etching experiments with non-acidified electrolytes produced accurate pattern transfer. An example of this is illustrated in FIG. 6; this pattern was etched using tool patterned as in FIG. 4 using a 0.1 M $CuSO_4$ solution with an applied current density of 1.0 $Acm^{-1}$ and an etching time of 180 seconds. The small squares in that pattern, with 100 μm×100 μm, are reproduced as a square with a flat bottom, as shown in the SEM (FIG. 6*a*) and the 3D optical profile (FIG. 6*b*). The length and depth scales are resolved in the 2D optical profile (FIG. 6*c*) etched copper sample; the feature length is 120 μm and the etch depth is 1.5 μm. Since best etching results were achieved into a 0.1 M $CuSO_4$ electrolyte with a conductivity of 2.7 $Sm^{-1}$, all etching experiment described below are reported for this specific electrolyte, unless stated otherwise.

From the above, it can be seen that varying the nature of the electrolyte whist keeping the tool pattern the same, can alter the pattern etched on the work piece.

The next parameter to be investigated was the effect of applied current density or cell voltage on pattern transfer characteristics. Etching experiments in the current density range between 0.3 $Acm^{-2}$ and 1.0 $Acm^{-2}$ were carried out to determine the performance at higher currents, where prepassive or transpassive dissolution is expected to occur. Overall, the etching experiments at high current densities showed better pattern transfer than the experiments in the active dissolution region. Etch depths up to 1.5 μm were reached for applied current densities of 1.0 $Acm^{-2}$ and an etching time of 180 s; however, when the etching time was increased beyond 180 seconds, the etch depth did not increase. This showed that that the substrate was dissolving at the same rate everywhere and that etching selectivity was lost.

Pattern transfer experiments were also carried out using a constant cell voltage between 1.0 V and 2.0 V. For applied cell potentials of 1.0 V the resulting current density rose up to a steady value between 3.5-7.0 $Acm^{-2}$. A current density rise to such high values could indicate dissolution in the transpassive region, and some of the experiments showed periodic oscillations with an amplitude of around 0.2 $Acm^{-2}$ and a frequency of 0.2-0.5 Hz. These periodic oscillations may be induced by sequential periods of film growth, oxidation, and partial dissolution and removal of salt and oxide layer (Lee, H. P., et al., *J. Electrochem. Soc.,* 132, 1031 (1985)).

Figure 7A:
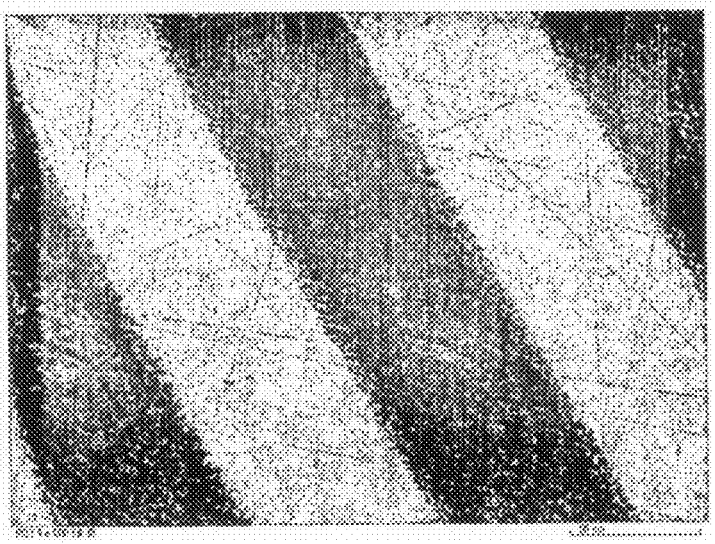
FIG. 7 shows (a) SEM, (b) 2D and (c) 3D profiles of another copper anode etched according to the present invention.
Figure 7B:
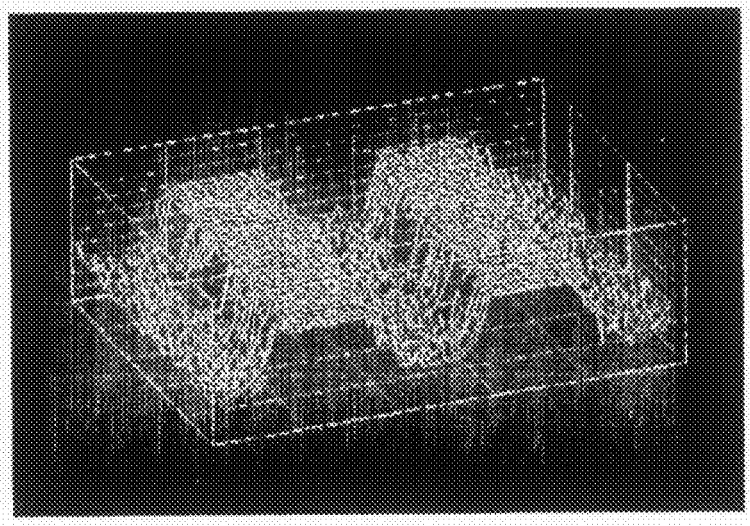
Figure 7C:
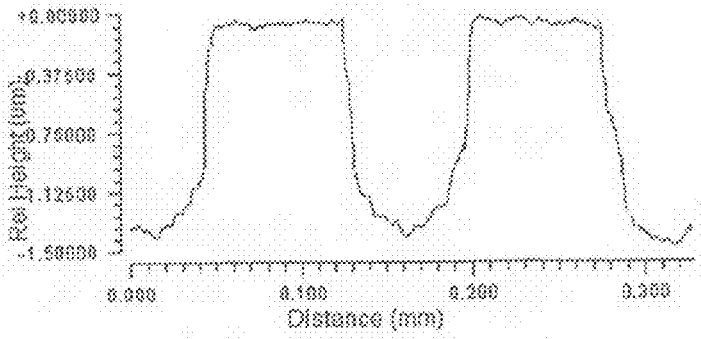

As shown by the SEM micrograph of a linear pattern in FIG. 7*a*, which was obtained by applying a constant potential 1.0 V for 180 seconds in a 1.0M $CuSO_4$ electrolyte, the etched area is relatively rough. The tool pattern was lines covered with photoresist which were 70 μm in width separated by an exposed area of 70 μm. The 3D optical profiles in FIG. 7*b* show the smooth top surface and a rough etched bottom surface, as observed in the SEM. The length and depth scales, as resolved in the 2D optical profile of FIG. 7*c*, show a line width of 70 μm and an etch depth of 1.5 μm. The profile of the etched lines shows relative vertical walls at the top but a curved bottom.

Figure 8A:
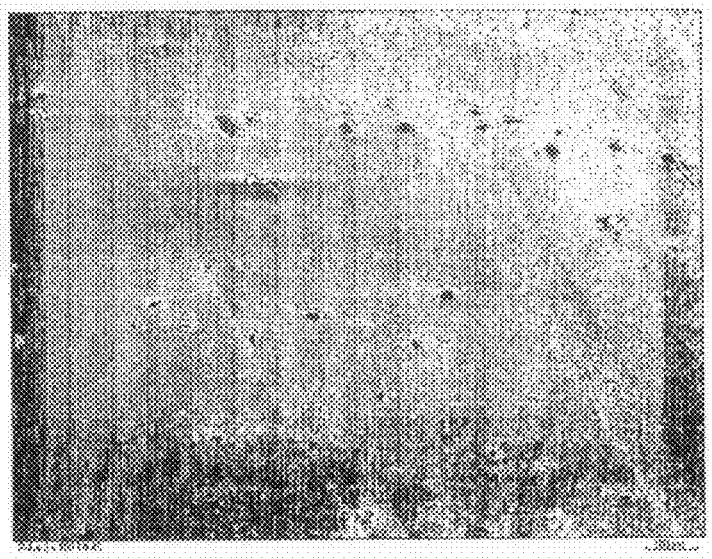
FIG. 8 shows (a) SEM, (b) 2D and (c) 3D profiles of a further copper anode etched according to the present invention.
Figure 8B:
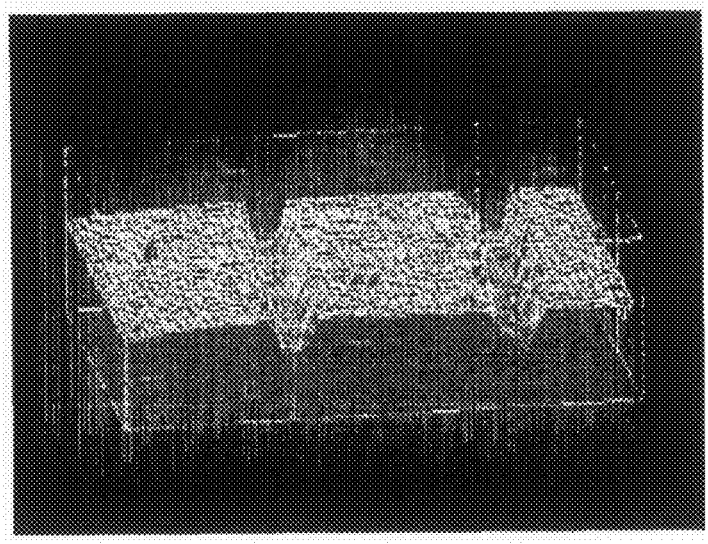
Figure 8C:
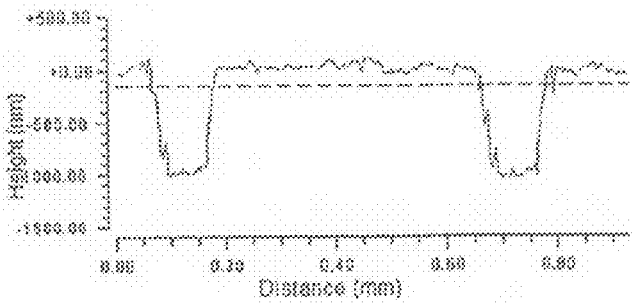

However, using pulsed cell voltages with a peak potential of either 10 V or 20 V were found to be more successful. The pulse-on time $t_p$ was varied between 1.0 ms and 10.0 ms with duty cycles between 0.01 and 0.1. FIG. 8*a* shows the scanning electron micrograph, FIG. 8*b* the 2D optical profile and FIG. 8*c* the 3D optical profiles of an etched copper sample using pulsed voltages. The original micropattern consisted of exposed linear features of 10 μm separated by a resist covered area of 50 μm. This was obtained using 4000 pulse cycles of 20 V voltage pulses and 1 ms on time and a duty cycle of 0.02. The 2D scale resolution shows an etch depth of 1.0 μm, a feature width of about 10 μm, with relative vertical walls and a flat bottom. In contrast to the active dissolution experiments, as the cycle numbers (hence etching time) were increased, the etch depth increased. For 20,000 pulse cycles, an average etch depth of 3.3 μm was obtained.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A method of depositing or etching a micro- or nano-scale pattern on a work-piece, comprising:

a) placing the work piece in an electrochemical reactor proximate to a patterned tool;

b) connecting the work piece such that it is the anode if is to be etched or the cathode if it is to be deposited, and the patterned tool such that it is the counter electrode;

c) pumping electrolytic fluid necessary for the electrolytic operation of the cell formed between the two electrodes;

d) applying a current across the electrodes to etch or deposit the work piece; and e) maintaining the electrodes relatively stationary during deposition or etching of the micro- or nano-scale pattern;

wherein the ratio of the distance between the electrodes and the size of the features to be patterned is about 10:1 to 1:10.

2. The method according to claim 1, wherein the work piece is preferentially etched or deposited in the areas that face exposed parts of the counter electrode, relative to those areas of the counter electrode that are masked by an insulating coating.

3. The method according to claim 1, wherein the ratio is about 10:1 to 1:1.

4. The method according to claim 1, wherein the patterns on the work piece are formed in gold, copper or aluminum.

5. The method according to claim 4, wherein the electrolytic fluid is a copper sulphate solution, the work piece is a copper disc and the current is applied to etch the work piece.

6. The method according to claim 1, wherein the electrolytic fluid is 0.1M copper sulphate solution.

7. The method according to claim 1, wherein the interelectrode gap is about 500 μm.

8. The method according to claim 1, wherein the pattern on the tool comprises a coating of electrically insulating, chemically inert material.

9. The method according to claim 8, wherein the work piece lacks a photo-resist masking material.

* * * * *